United States Patent [19]

Beery

[11] 4,133,262

[45] Jan. 9, 1979

[54] INKING APPARATUS

[75] Inventor: Jack Beery, Farmington, Mich.

[73] Assignee: Burroughs Corporation, Detroit, Mich.

[21] Appl. No.: 824,527

[22] Filed: Aug. 15, 1977

Related U.S. Application Data

[62] Division of Ser. No. 650,707, Jan. 20, 1976, Pat. No. 4,069,755.

[51] Int. Cl.[2] ..... B41F 31/00

[52] U.S. Cl. ..... 101/350; 101/91; 101/101; 101/235

[58] Field of Search ..... 101/91, 97, 98, 101, 101/108, 348-358, 235

[56] References Cited

U.S. PATENT DOCUMENTS

| | | | |
|---|---|---|---|
| 2,384,035 | 9/1945 | Keuper | 101/101 |
| 3,795,190 | 3/1974 | Wallace | 101/91 X |
| 3,901,150 | 8/1975 | Kirby | 101/351 |
| 4,037,531 | 7/1977 | Ritzerfeld | 101/91 |
| 4,044,677 | 8/1977 | Hamisch | 101/348 |

*Primary Examiner*—Edward M. Coven

*Attorney, Agent, or Firm*—Charles P. Sammut; David R. Syrowik; Carl Fissell, Jr.

[57] ABSTRACT

An endorser for use in document processing apparatus is provided with a matrix wire printer for printing variable information on documents as they are transported at a controlled speed along a transport path forming part of an endorsing station, and with a rotatable ink stamp driven by a controlled speed motor for printing fixed information on the documents in predetermined relationship with the variable information. A rotatably mounted endorser head assembly comprised of a velocity control member and an interrupted curvilinear platen, in addition to the ink stamp, is drivably rotated by the controlled speed motor to initially intercept and decelerate a document entering the endorsing station, and to thereafter print the fixed and variable information on the document. Deceleration of the document is accomplished by the velocity control member of the endorser head assembly in cooperation with a first biased back-up roller. The printing of the fixed information is accomplished by the ink stamp of the endorser head assembly in cooperation with a second biased back-up roller, and the printing of the variable information is accomplished by the matrix wire printer in cooperation with thea curvilinear platen of the endorser head assembly. The ink stamp and curvilinear platen are continuously inked by a rotatable ink transfer member that is adjustably maintained in frictional contact with the ink stamp and the platen.

4 Claims, 13 Drawing Figures

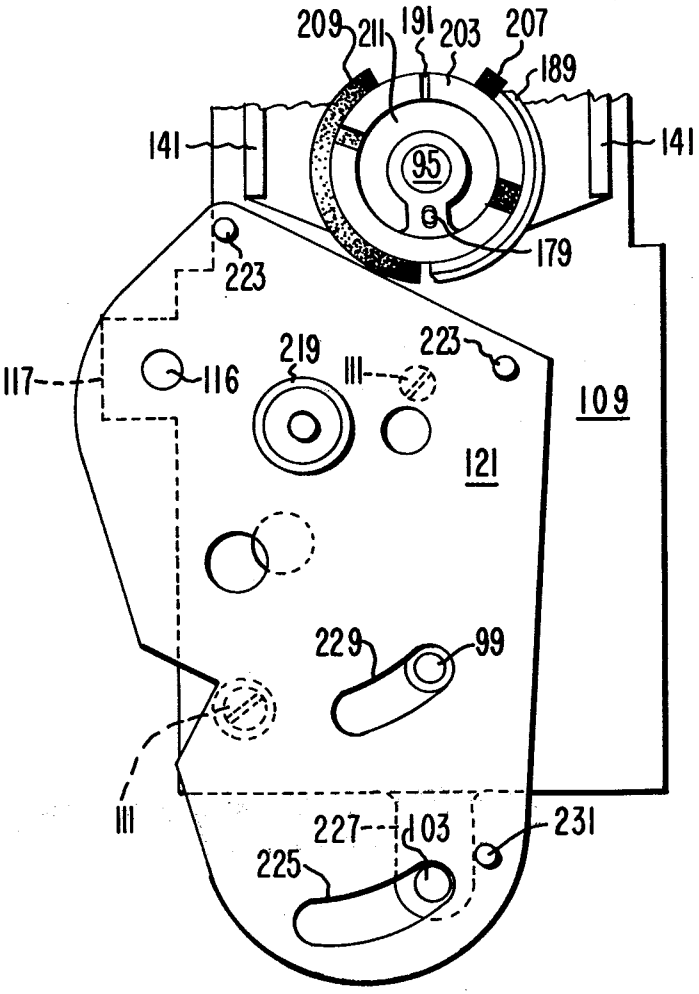
FIG. 10B. CW
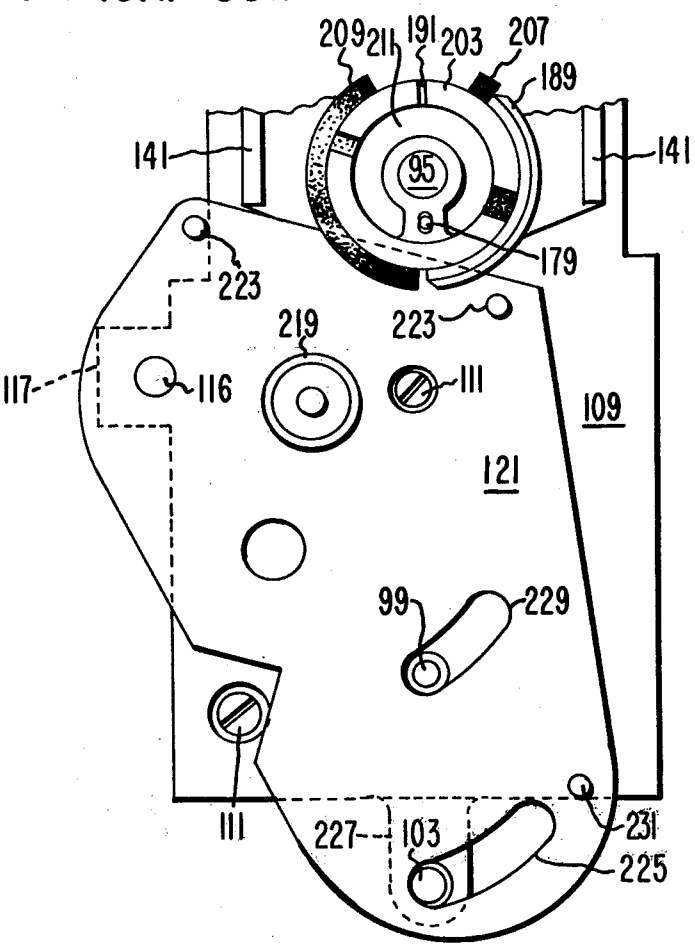
FIG. 10A. CCW

IMPROVED INKING APPARATUS

This is a division of application Ser. No. 650,707, filed Jan. 20, 1976, now U.S. Pat. No. 4,069,755.

CROSS REFERENCE TO RELATED APPLICATIONS

The ribbonless endorser of the present invention may be used, for example, in the Modular Document Encoder shown in U.S. Ser. No. D-574,722 filed on May 5, 1975 by R. Clayton and R. Schade, now abandoned, and in association with structures and devices disclosed in the following related United States patent applications, said applications all being assigned to the assignee of the present application:

U.S. Ser. No. 642,061 filed Dec. 18, 1975 by K. Christou and K. Kruklitis, now U.S. Pat. No. 4,031,359 entitled "A Straight Line Road System";

U.S. Ser. No. 573,787 filed May 1, 1975 by W. Templeton, now U.S. Pat. No. 3,972,522 entitled "Method And Apparatus For Identifying Characters Printed On A Document Which Cannot Be Machine Read";

U.S. Ser. No. 609,222 filed Sept. 2, 1975 by H. Wallace, now U.S. Pat. No. 3,922,522 entitled "Document View Station";

U.S. Ser. No. 608,567 filed August 28, 1975 by W. Templeton, now U.S. Pat. No. 4,028,286 entitled "Method And Apparatus For Driving A Document Through An Encoder Station";

U.S. Ser. No. 591,856 filed June 30, 1975 by J. Neri and J. Williams, now U.S. Pat. No. 4,028,286 entitled "Ink Transfer Member";

U.S. Ser. No. 650,723 filed Jan. 20, 1976 by J. Beery, now U.S. Pat. No. 4,033,444 entitled "Improved Pin Printer Life Utilizing Pin Shifting";

U.S. Ser. No. 897,687 filed Apr. 19, 1978 by J. Beery entitled "Optical Tachometer Using An Apertured Collimating Device";

U.S. Ser. No. 773,007 filed Feb. 28, 1977 by J. Haas, now U.S. Pat. No. 4,088,982 entitled "Dot Printer Delay Correction By Line Frequency Synchronization"; and

BACKGROUND OF THE INVENTION

Known endorsers for printing information either on the front or rear sides of documents such as checks have generally provided for the printing of fixed or constant information by means of a rotating legend-carrying print head that serves to impress an inked ribbon into contact with the document. Other of these known endorsers have provided for the printing of variable information by means of such complex devices as ink jet printers wherein uniformly sized droplets of ink are pressurably ejected from a nozzle and variably deflected electrostatically or magnetically in free flight towards the moving document, the movement of the document in concert with the variable vertical sweeps of the droplet stream serving to form the individual characters of the variable information.

The prior art fixed information endorsers, in addition to being ineffective for printing variable information, have generally required inked ribbons and their associated troublesome and space-taking feed and reverse mechanisms, and the prior art variable information endorsers, although appropriate for use in large scale document processing equipment, have generally proven to be too expensive for use in smaller scale cost effective special purpose equipment such as document encoders, the primary objective of such special purpose equipment being the preliminary encoding and sorting of documents preparatory to subsequent automatic processing.

SUMMARY OF THE INVENTION

It is accordingly an object of the present invention to provide a low cost and reliable document endorser that is effective for printing both fixed and variable information on documents as they are transported at a controlled speed along a document transport path.

It is another object of the present invention to provide a fixed and variable information endorser wherein neither the fixed information nor the variable information requires the use of an inked ribbon and its complex and troublesome feed and reverse devices.

It is still a further object of the present invention to provide a document endorser that affords a highly flexible output capability, and wherein common element are employed in the printing of both the fixed and variable information.

An important aspect of the present invention is the use in a unitary device of a wire matrix printer for printing variable information on the documents, and a rotatable legend-carrying ink stamp for printing predetermined fixed information thereon, common multipurpose elements being employed in printing both the fixed and variable information and for controlling the speed of movement of the documents throughout each endorsing cycle.

Another important aspect of the present invention is the employment of a simple and readily accessible ink supply member in lieu of one or more feedable and reversible inked ribbons in the printing of both the fixed and variable information, such ink supply member requiring a minimum of operating parts to transfer the ink both to the wire matrix printer and to the ink stamp printer.

BRIEF DESCRIPTION OF THE DRAWING

These and other objects, advantages and features of the invention will become more readily apparent from the following detailed description when read in conjunction with the accompanying drawing figures, in which:

FIGS. 10A and 10B are plan views of the adjustable friction setting means of the ink transfer member as disposed in its clockwise and counterclockwise-rocked positions, the adjusting knob of the friction setting means having been removed to expose normally hidden details;

DESCRIPTION OF THE PREFERRED EMBODIMENT

Figure 1:
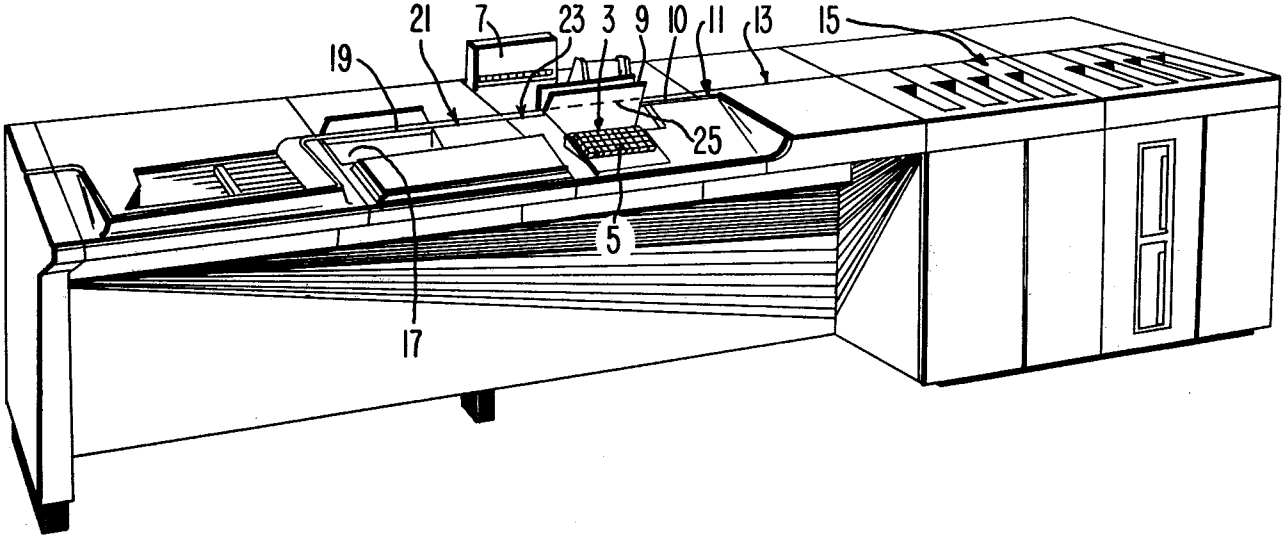
FIG. 1 is a perspective view of a modular document encoder in which the inventive unitary endorser may be used.

The ribbonless endorser for printing both fixed and variable information on documents may be utilized in any document processing equipment wherein, as an incident to such processing, it is desired to record an endorsement on either the front or rear sides of the documents. It may be used effectively, for example, in the Modular Document Processing Encoder illustrated in FIG. 1 and disclosed by R. Clayton and R. Schade in U.S. Ser. No. D-574,722 filed on May 5, 1975, now abandoned. In the particular document processing encoder shown in FIG. 1, a quantity of documents such as bank checks that have been received by a bank and that are to be amount encoded in MICR characters would be edge-stacked in a hopper 3, individually removed from the hopper and viewed by the operator, the operator then proceeding to enter the amount of each check by means of a keyboard 5. In the event the intended amount appears on a display panel 7, the operator would drop the individual checks into a chute 9 whereupon they would be activated along a document transport path 10 to an encoding station generally designated at 11 where the amount entered by means of the keyboard would be encoded in MICR characters. Following the encoding of the amount at the encoding station 11, the checks would be transported to or through an endorsing station generally designated at 13 where information peculiar or unique to the processing bank might be recorded on the checks, the checks being thereafter transported to selected ones of a plurality of stacking pockets generally designated at 15.

The modular document processing encoder illustrated in FIG. 1, and for which the endorser unit of the present invention was particularly designed, may also be used for verifying the machine readability of the MICR encoded characters recorded on the checks, including the above referenced amount encoded characters and the pre-recorded characters of a customer and bank identifying nature. To accomplish such verification, a quantity of encoded checks would be edge-stacked in a hopper 17 and dropped individually by the operator into a chute 19 where they would be transported along the document transport path through a read station generally designated at 21, a dot printer station generally designated at 23, a document view station 25, the previously mentioned encoder station 11, and then through the endorser station 13 to selected ones of the pockets 15, according to the bank identifying characters that were read at the read station 21. During this verification of the machine readability of the encoded characters on the checks, each of the encoded characters would be exposed to a read head located at the read station 21, after having first been magnetized by a write head also located at the read station. In the event all of the encoded characters on a given check are read by the read head at the road station 21, the check would be transported without incident along the document transport path generally designated at 10, and through the various downstream stations to the selected pocket 15. Should one or more of the encoded characters on a given check not be read by the read head, however, the unread characters would be markably identified by a dot printer located at the dot printer station 23, the check being thereafter elevated at the document view station 25 for visual observation by the operator. The dot-identified unread characters would then be interpreted by the operator, and the correct characters entered by means of the keyboard 5. Upon re-entry of the unread character or characters, the check would then be transported to the encoding station 11 where encoding of the re-entered characters would occur, the check being thereafter transported through the endorser station 13 to the selected pocket 15.

To elaborate further on the particular structure of the Modular Document Processing Encoder illustrated in FIG. 1, the "Straight Line Read System" disclosed by K. Christou and K. Kruklitis in, now U.S. Pat. No. 4,031,359 might be located at the read station 21, the "Apparatus For Identifying Characters Printed On A Document Which Cannot Be Machine Read" disclosed by W. Templeton in U.S. Pat. No. 4,068,212, might be located at the dot printer station 23, the "Document View Station" disclosed by H. Wallace in U.S. Pat. No. 3,972,555 might be located at station 25, the "Apparatus For Driving A Document Through An Encoder Station" disclosed by W. Templeton in U.S. Pat. No. 4,015,701 might be located at the encoder station 11, and with the ribbonless endorser of the present application located at station 13.

Figure 3:
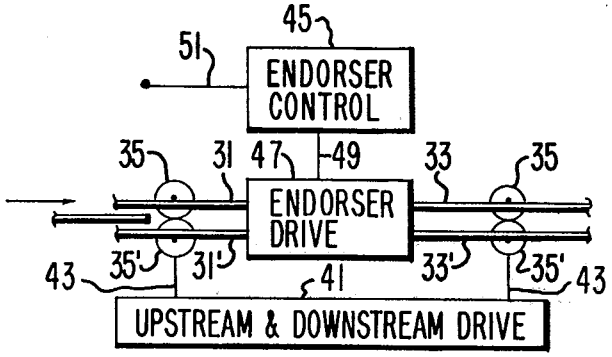
FIG. 3 is a block diagram generally illustrating drive means for transporting documents at a first speed both upstream and downstream of the endorser station, and for transporting the documents at a second slower speed through the transport path defining the endorser station.
Figure 2:
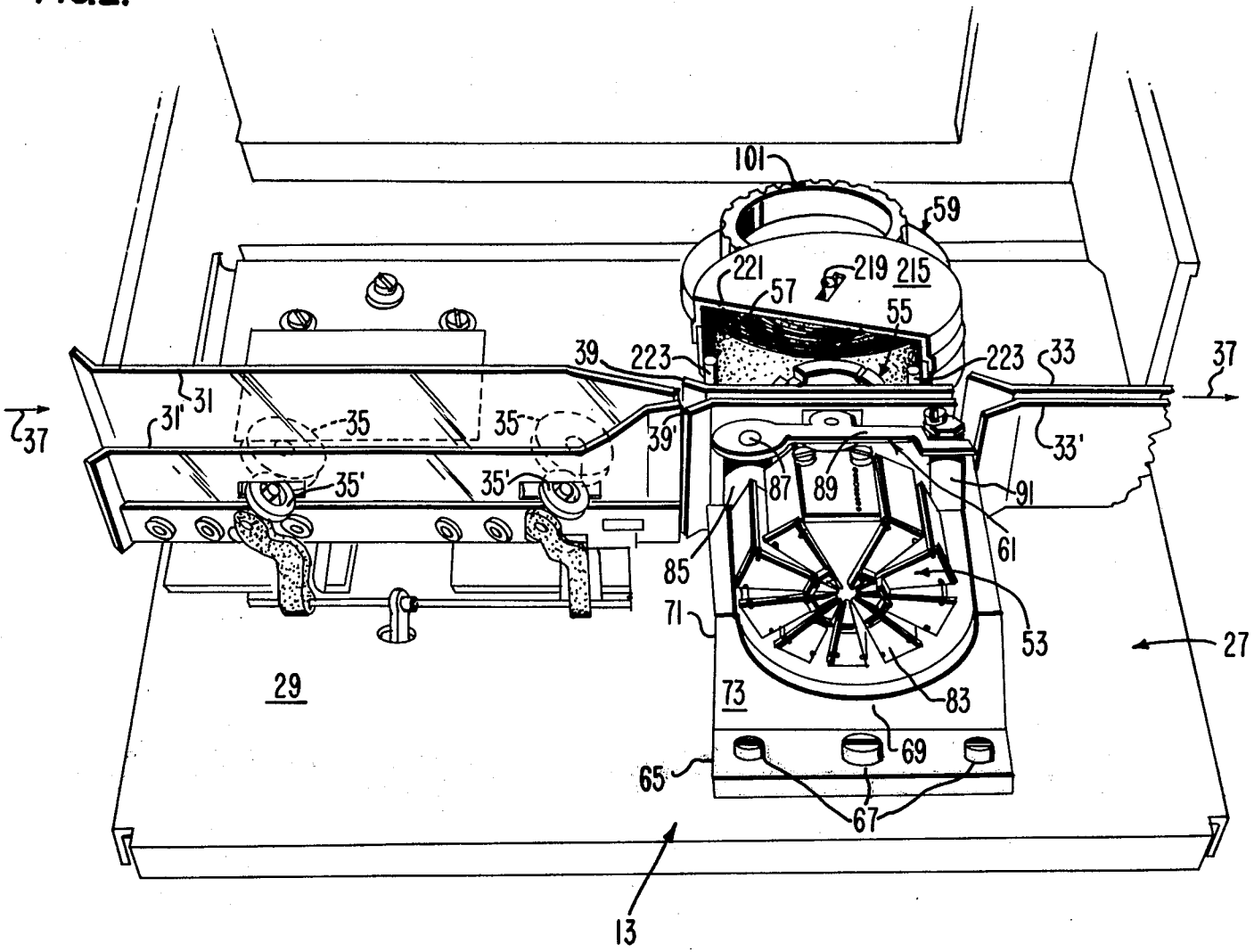
FIG. 2 is a front perspective view of the endorser station of the modular document encoder in relationship to upstream and downstream sections of the document transport path thereof.

As illustrated in FIG. 2, the endorser station generally designated at 13 in FIG. 1, in addition to the endorser unit of the present invention which is generally designated at 27, might also be comprised of a base plate 29, a pair of upstream path-defining walls 31, 31', a pair of downstream path-defining walls 33, 33', and pairs of drive means or rollers 35, 35' that are operatively disposed along the upstream and downstream path-defining walls for transporting at a predetermined transport speed in the direction of the arrows 37. Intermediate the pairs of path-defining walls 31, 31' and 33, 33', are a pair of path-defining walls 39, 39' defining the transport path in the area of the endorser station, the documents or checks being transported at a controlled reduced speed therealong as the fixed and variable information is endorsably printed on the documents. FIG. 3 is illustrative of the manner in which a document being transported along the document transport path 10 and through the various upstream stations shown in FIG. 1 may be transported at a relatively high transport speed in the upstream pathway 31, 31', decelerated to a controlled slower endorsing speed in the endorser pathway 39, 39', and then re-accelerated to the relatively high transport speed in the downstream pathway 33, 33'. For this purpose an upstream and downstream drive designated at 41 in FIG. 3 might serve to control the relatively high transport speed of the documents in the pathway areas adjacent the endorser transport path 39, 39', by providing speed control functions to the drive means 35, 35' along the lines 43, with an endorser control designated by the block 45 serving to supply speed control functions to an endorser drive 47 along a line 49 upon receipt of an endorse initiate signal from a central processor or other extraneous logic system along the line 51.

Figure 5:
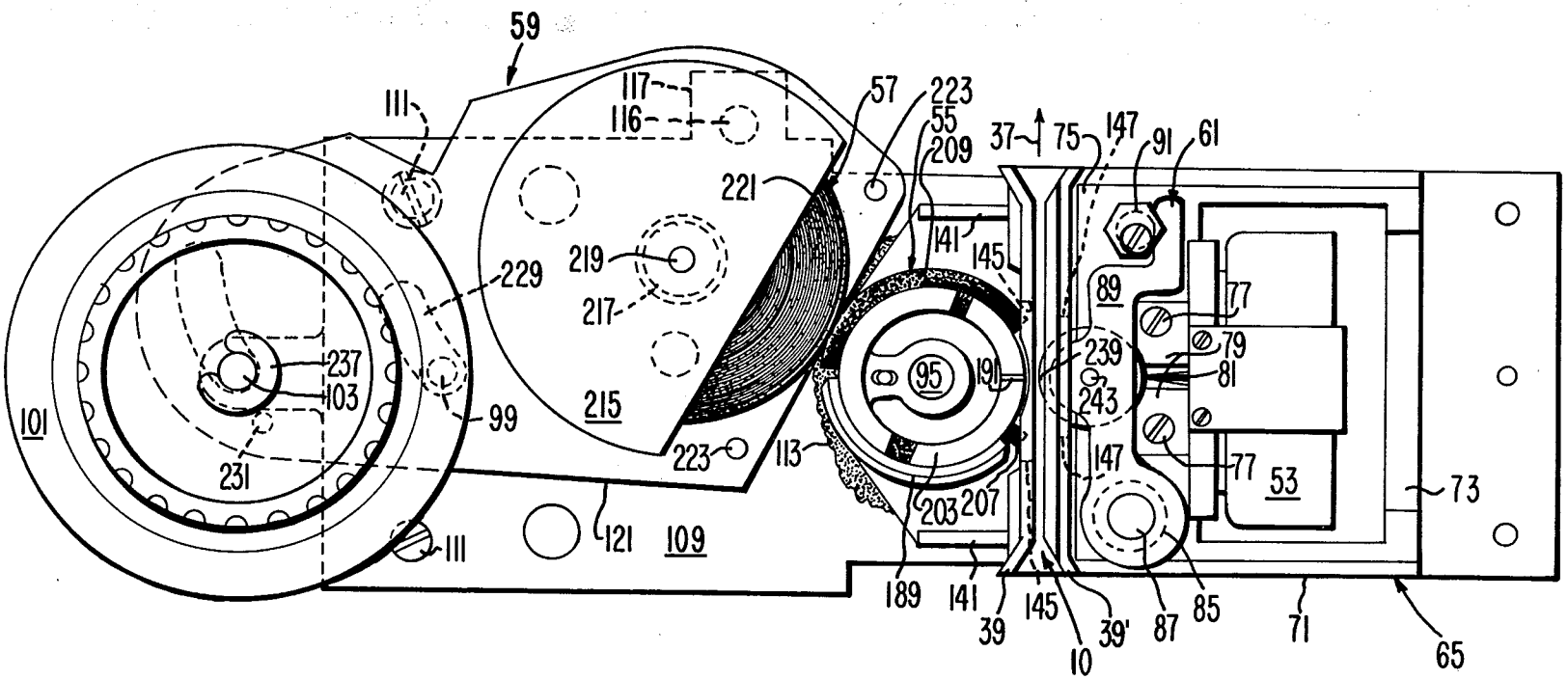
FIG. 5 is a plan view of the inventive endorser unit showing the relationship of various of its operating elements.

As best illustrated in FIGS. 2, 5, 6 and 7, the unitary endorsing device of the present invention is comprised of a wire matrix printer generally designated at 53 for printing variable information on the documents, an endorser head assembly generally designated 55 and comprised of a plurality of hereinafter described operating elements, an ink transfer member 57, means generally designated at 59 for maintaining a minimal frictional contact between the ink transfer member 57 and the endorser head assembly 55, biased means generally designated at 61 for providing back-up support to the velocity control element and ink stamp of the endorser head assembly 55, and a drive motor 63 responsive to logic circuitry for rotating the endorser head assembly 55 at a controlled speed during each endorsing cycle. The endorser unit generally designated at 27 in FIG. 2 is supported by a casting 65 that is best illustrated in FIGS. 2, 6, 7 and 8, such casting being attached to the base plate 29 by means of a plurality of front and rear fasteners or screws 67. A semi-circular housing portion 69 is provided in the casting 65 for securably locating the wire matrix printer 53, such housing portion being comprised of a pair of vertical side walls 71, a cutaway front end wall 73, and a ledge-forming rear wall 75. The wire matrix printer 53, as best illustrated in FIG. 5, is supported in the housing portion 69 by means of a pair of screws 77 passing through apertures formed in a pair of brackets 79 that are integrally formed with the wire matrix printer, such screws cooperating with threads formed in the ledge of the rear wall 75. The space between the brackets 79 serves as a guideway 81 for nine vertically arranged pins of the wire matrix printer 53, the desired variable information being endorsably printed on the documents by selectively energizing nine radially arranged pin-activating solenoids 83 as best shown in FIG. 2. Logic circuitry for the selective activation of the nine radially arranged solenoids 83, and for conservationally activating seven of the nine pins that are vertically arranged in the guideway 81 is disclosed in previously referenced U.S. Pat. No. 4,033,444 by J. Beery.

Figure 6:
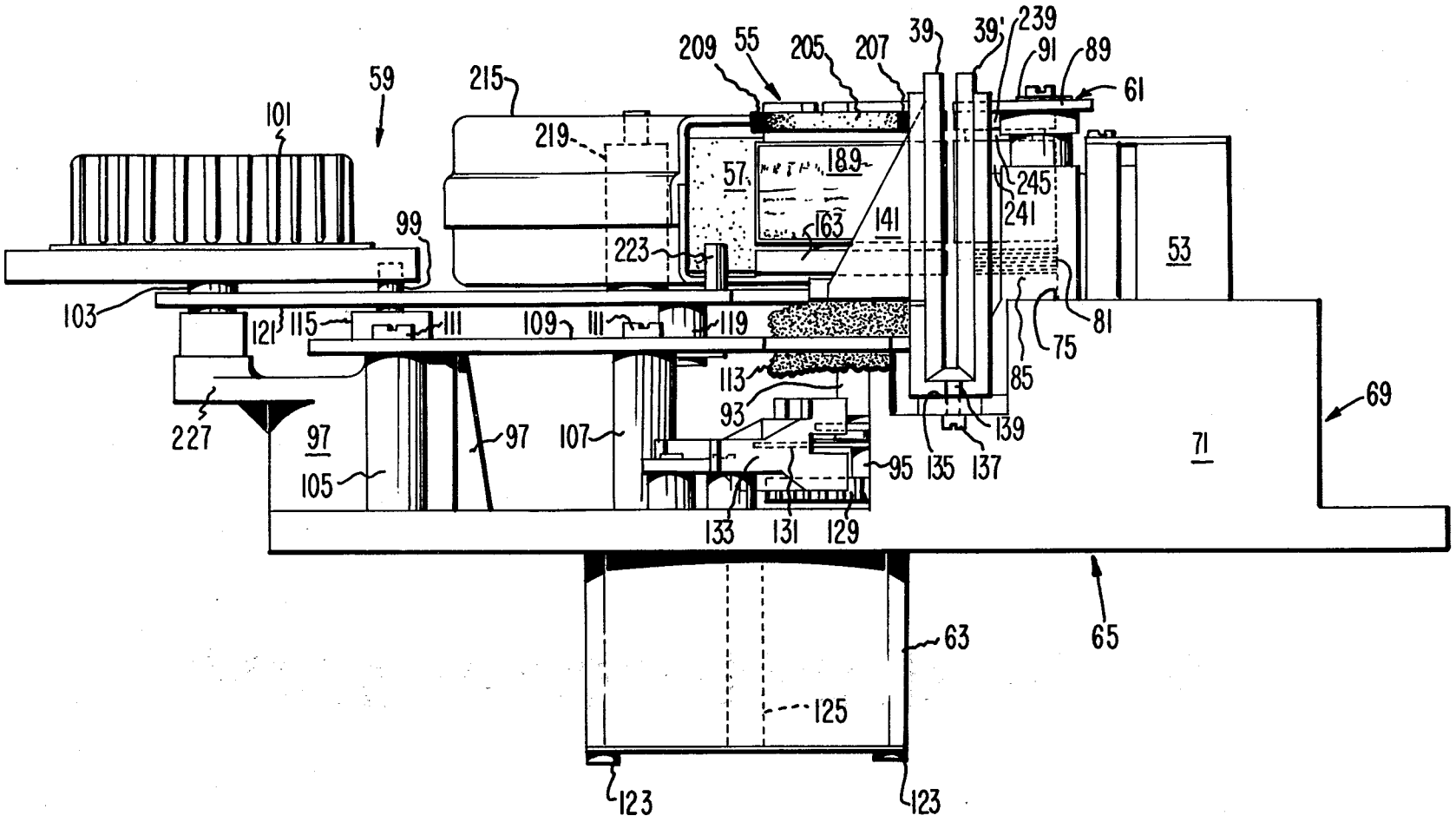
FIG. 6 is a left side view of the endorser showing additional elements thereof.

Extending upwardly from the ledge-forming rear wall 75 of the housing portion 69, as best shown in FIG. 6, is a first bearing mount 85 for supporting a rotatable shaft 87 (FIG. 5) of the hereinafter described biased back-up means 61, the shaft 87 being biased in a counterclockwise direction as viewed in FIG. 5 to yieldably limit a roller carrying arm 89 against an adjustable limit stop 91 that is fixed to the ledge 75.

Figure 7:
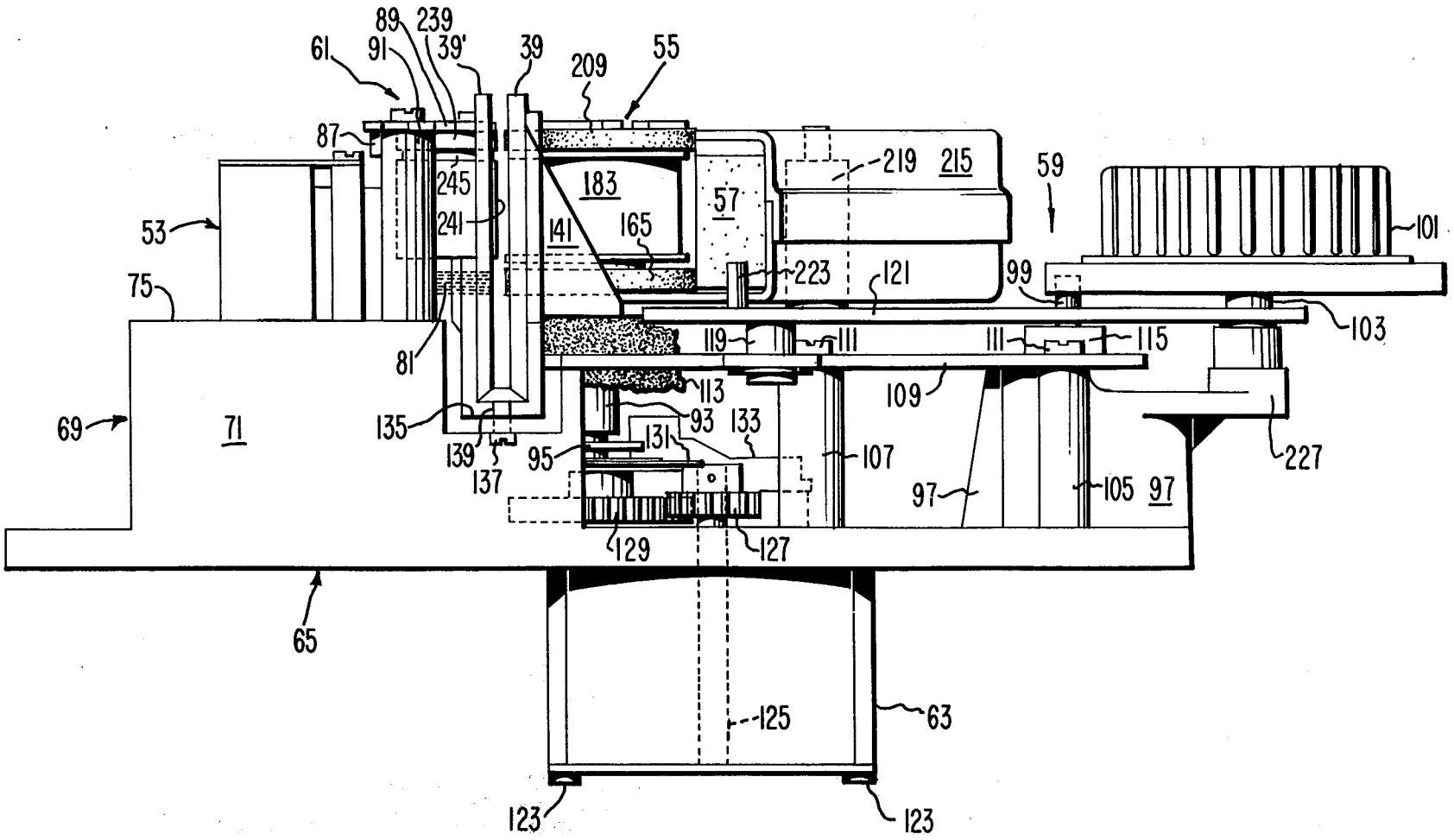
FIG. 7 is a right side view of the endorser unit otherwise illustrated in FIGS. 5 and 6.

The casting 65, as best shown in FIGS. 6 and 7, is also provided with a second bearing mount 93 for supporting a shaft 95 of the endorser head assembly 55, and with a third bearing mount 97 for translatably supporting a biased detent 99 that positionably cooperates with a plurality of hereinafter described radially arranged indentions on the lower surface of an adjusting knob 101, and for supporting a short shaft 103 about which the adjusting knob 101 may be rotated. The casting 65 is additionally provided with a pair of integrally formed rear supporting posts 105 disposed on either side of the third bearing mount 97, and an integrally formed forward supporting post 107, such supporting posts serving to position an anchor plate 109 by means of locating screws 111. The anchor plate 109, in addition to being positionably located by the supporting posts 105, 107, and the screws 111, is also cushionably supported at its frontmost extremity by means of a shoulder (not shown) that is formed in the second bearing mount 93, a matting of any suitable resilient material 113 serving to mechanically insulate the anchor plate 109 from the bearing 93 and from the endorser head assembly 55. The anchor plate 109 is provided with an aperture (not shown) for accommodating a collar housing 115 for the biased detent 99, such collar housing being fixed to the uppermost extremity of the third bearing mount 97. An aperture 116 formed in an extension 117 of the anchor plate 109, as best illustrated in FIGS. 5, 10A and 10B, serves to rotatably accommodate a pivot post 119 (FIG. 7) that is fixed to a pivotally operable friction setting plate 121 the function of which is hereinafter described.

Figure 8:
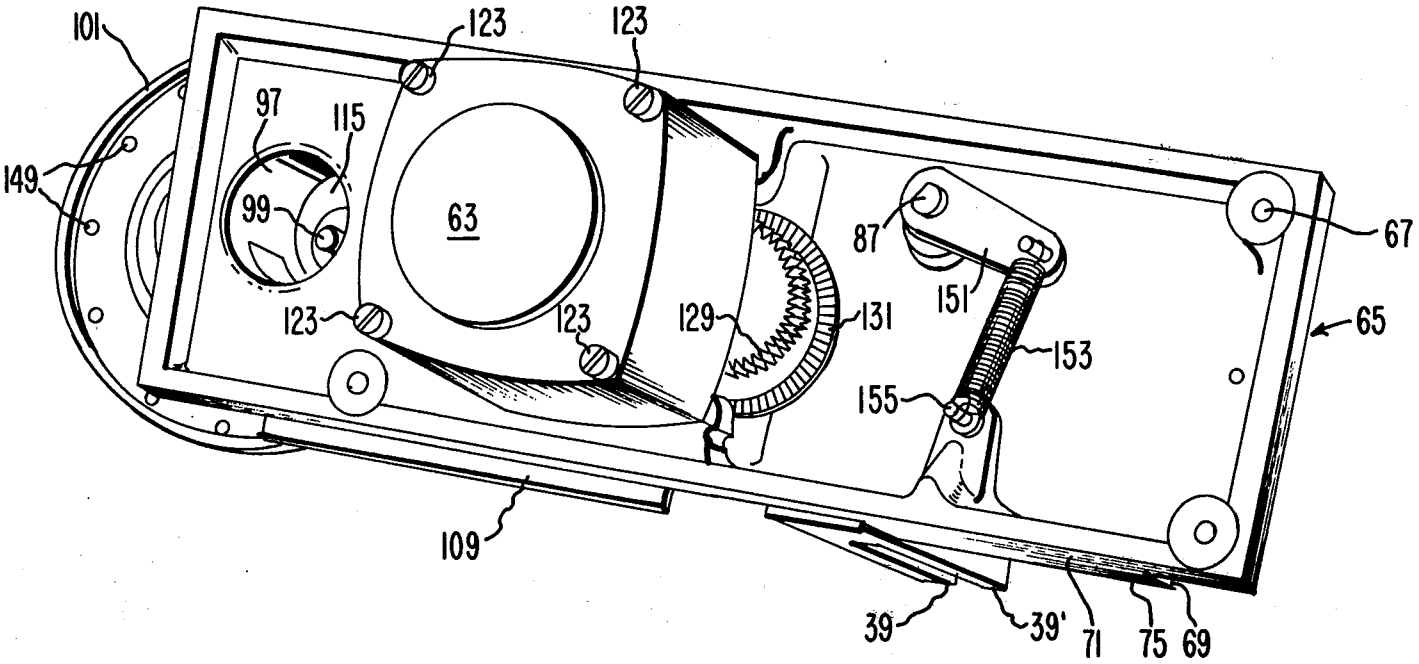
FIG. 8 is a bottom perspective view of the endorser unit showing additional details of its unitary assembly.

The casting 65 also serves to support the drive motor 63 which depends from the bottom surface thereof and extends through an opening formed in the base plate 29, the housing of the motor 63 being provided with a plurality of peripheral apertures for accommodating a plurality of fasteners 123 that pass through corresponding apertures formed in the casting 65, as best illustrated in FIG. 8. Also passing through an aperture formed in the casting 65 is a geared motor shaft 125, a pinion gear 127 fixed thereto being cooperably engaged with the teeth of a spur gear 129 fixed to the lowermost extremity of the shaft 95 of the endorser head assembly 55. Also fixed to the shaft 95 of the endorser head assembly is an apertured disk 131 disposed in cooperating relationship with an LED and photodetector device 133 (FIG. 6), such apertured disk and photodetector device being the subject matter of U.S. Ser. No. 897,687 filed by J. Beery on Apr. 19, 1978 and entitled "Optical Tachometer Using An Apertured Collimating Device".

The casting 65 is also provided with a depressed surface 135 disposed in adjacent relationship to the ledge 75, as best illustrated in FIGS. 6 and 7, such surface serving to support the path-defining wall 39' and the integrally formed lower portion of the wall 39. A plurality of threaded bolts 137 pass through apertures formed in the depressed surface 135 and grippably cooperate with the interior walls of a plurality of sleeves 139 which are integrally formed with the path-defining wall 39'. The upper portion of the path-defining wall 39 is supported by a pair of integrally formed flaired members 141 that are anchored to the second bearing mount 93 contiguous to the upper surface of the resilient material 113. The path-defining wall 39 is provided with a central rectangularly shaped aperture designated by the broken lines 145 in FIG. 5, to permit the rotatable projection of various elements of the endorser head assembly 55 into the document transport path and into cooperation with documents passing therethrough, and the path-defining wall 39' is provided with a central rectangularly shaped aperture designated by the broken lines 147 whereby the roller assembly of the biased back-up means 61 and carried by the arm 89 is permitted entry into the document pathway to provide back-up support to a document that is disposed in cooperating relationship with the various elements of the endorser head assembly 55.

FIG. 8 of the drawing shows the inner surface of the third bearing mount 97, the biased detent 99, and the collar housing 115 for translatably supporting the detent. Also shown in FIG. 8 are the previously mentioned locating indentions 149 that are formed in the bottom surface of the adjusting knob 101, such indentions being selectively engaged by the detent 99 to adjustably locate the pivotably operable friction setting plate 121 in such manner as to establish a minimal frictional contact between the ink transfer member 57 and various elements of the endorser head assembly 55. FIG. 8 also shows the means whereby the previously referenced back-up support means 61 is biased with the roller carrying arm 89 thereof normally held in contact with the adjustable limit stop 91 (FIG. 5), such biasing means including an arm 151 fixed to the lowermost extremity of the shaft 87, and a spring 153 connecting the arm 151 and an anchor pin 155 fixed to the lower surface of the casting 65.

Figure 9:
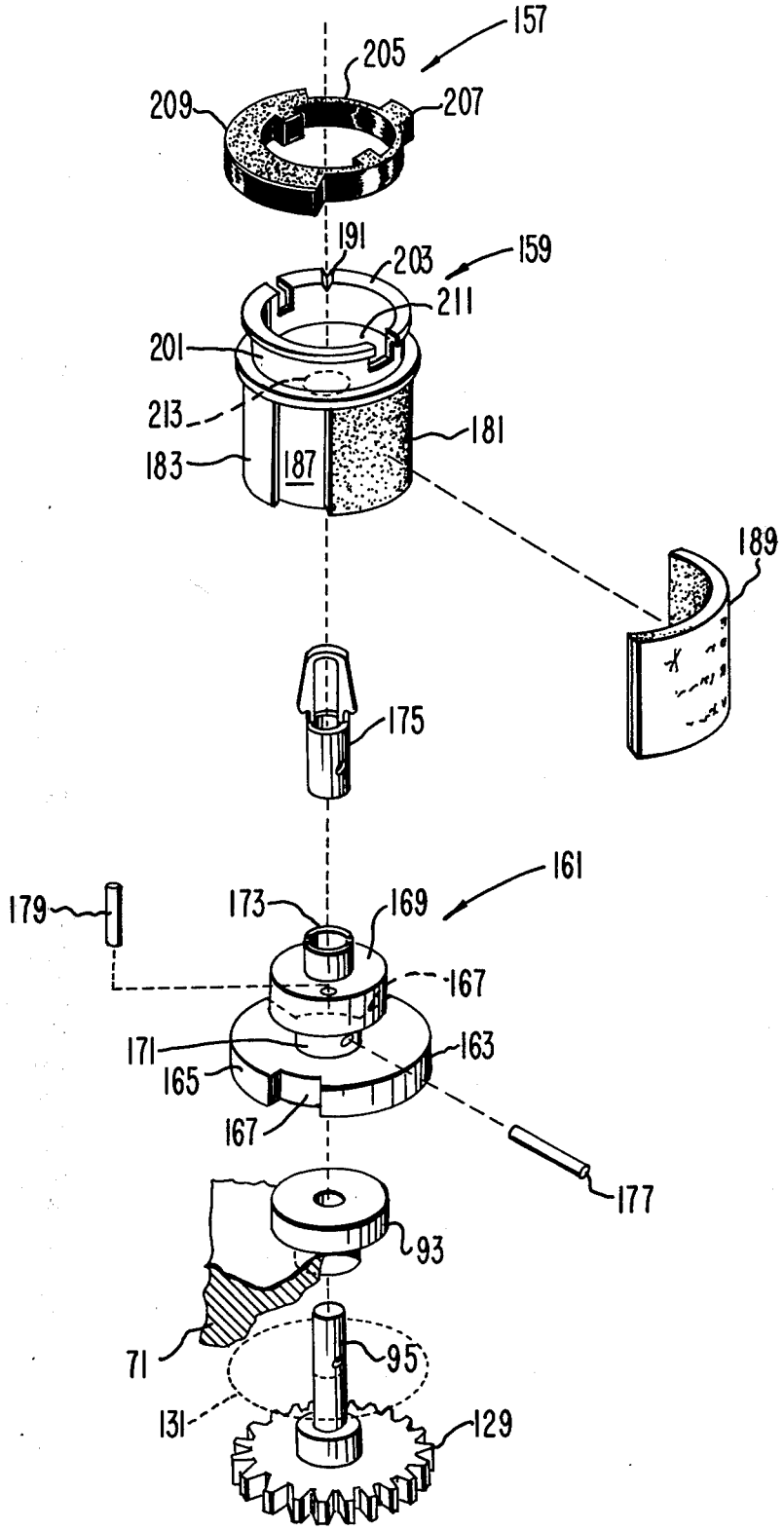
FIG. 9 is an exploded view of the endorser head assembly showing the velocity control element, the ink stamp and the curvilinear platen thereof.

The endorser head assembly 55 shown to be mounted on a rotatable shaft 95 in FIG. 5, and to be rotatable by the drive motor 63 through the coupling of the pinion gear 127 and the spur gear 129 in FIG. 7, can best be described with reference to FIG. 9. Forming a part of the endorser head assembly 55 is a velocity control element 157, an ink stamp supporting element 159, and a platen element 161. The platen element 161 is comprised of a pair of exposed concentric arcuate surfaces 163 and 165 which are separated by a pair of recesses 167, an enlarged hub port on 169, an interconnecting sleeve portion 171, and an upwardly extending slotted sleeve portion 173. The sleeve portions 171 and 173 and the enlarged hub portion 169 are provided with an inner diameter of predetermined greater dimension than the outer diameter of the rotatable shaft 95, such than an insert sleeve 175 made of a resilient material may be retainably introduced therebetween. The platen element 161 is fixed to the shaft 95 by means of a dowel pin 177 passing through apertures formed in the sleeves 171 and 175 and the shaft 95. The platen element 161 is also provided with a vertically extending locating pin 179 disposed on the upper surface of the hub portion 169, the purpose of such locating pin being described hereinafter.

The ink stamp supporting element 159 is comprised of a pair of concentric arcuate surfaces 181 and 183 which are separated by a pair of oppositely disposed recesses 187 (only one of which is shown). An ink stamp 189 containing the fixed information is adhesively attached to the arcuate surface 181, with a second ink stamp (not shown) optionally attached in line manner to the arcuate surface 183 in the event the desired fixed information cannot be accommodated by a single ink stamp. The recess 187 opposite the one shown in FIG. 9, together with the corresponding recess 167 of the platen element 161, serve to define the home position of the endorser head assembly 55, the home positioning of the assembly being achieved when these recesses and a home designating mark 191 formed in the upper rim thereof are angularly disposed in coincidence with the rectangularly shaped aperture formed in the path-defining wall 39, as best illustrated in FIG. 5. The ink stamp supporting element 159, in addition to the arcuate surfaces 181 and 183 and recesses 187, is also provided with a circular channel 201 formed by an interrupted rim 203 which bears the home designating mark 191. The circular channel 201 serves to support an elastomeric band 205 that substantially comprises the velocity control element 157. The band 205 is provided with a first relatively narrow projection 207 disposed at a point contiguous to the leading edge of the ink stamp 189, and a second relatively wide projection 209 which extends from the trailing edge of the ink stamp 189 and terminates at a point coincident with the trailing edge of the arcuate surface 183. To provide further elaboration upon the relationship of the projections 207 and 209 of the velocity control element 157 and the ink stamp 189, it can be seen from FIG. 5 that when the endorser head assembly 55 is disposed in its home position the projections 207 and 209 of the velocity control element 157, the ink stamp 189 and arcuate surface 183 of the ink stamp supporting element 159, and the arcuate surfaces 163 and 165 of the platen element 161 are all displaced from the aperture formed in the path-defining wall 39, and that upon the counterclockwise rotation of the shaft 95 and endorser head assembly 55 the first projection 207 of the velocity control element 157 serves to intercept a document moving at a high transit speed along the passageway 10, and to deceleratably impinge the document against a hereinafter described first roller of the back-up support means 61. Following the deceleration of the document by the projection 207 and first roller of the back-up means 61, the ink stamp 189 in cooperation with a second roller of the back-up support means 61 serves both to endorsably print the fixed information contained thereon and to control the speed of movement of the document during such printing. Following the printing of the fixed information by the ink stamp 189, the reduced speed movement of the document through the endorser station is maintained by the relatively wide projection 209 of the velocity control element 157 in cooperation with the first roller of the back-up support means 61. Upon completion of the 360° rotation of the shaft 95 the endorser head assembly 55 is returned to its home position as shown in FIG. 5, the various elements of the assembly being again displaced from the rectangularly shaped aperture in the path-defining wall 39, and displaced also from a position of possible interference in the document pathway.

The ink stamp supporting element 159 is provided with a lower interior chamber of such dimension as to provide a slip fit with the enlarged hub portion 169 of the platen element 161, when assembled thereon. A circular partition 211 formed in the ink stamp supporting element 159, midway of its extremities, is provided with a central circular aperture 213 for receiving the upwardly extending slotted sleeve 173 of the platen element 161, and provided also with an adjoining smaller aperture (not shown) for receiving the vertically extending locating pin 179 of the hub portion 169. With the ink stamp supporting element 159 assembled on the home positioned platen element 161, the various elements of the endorser head assembly will appear as generally represented in FIGS. 5 6, and 7 with the exposed arcuate surfaces 163 and 165 of the platen element 161 disposed in cooperable print-receiving relationship with the pins of the wire matrix printer 53, with the ink stamp 189 disposed in cooperable print-producing relationship with the second roller of the biased back-up support means 61, and with the velocity control elements 207 and 209 disposed in cooperable document-decelerating relationship with the first roller of the biased back-up support means 61.

As indicated supra, the inventive unitary endorser includes an ink transfer member 57 and means designated at 59 for maintaining a minimal frictional contact between the ink transfer member 57 and the endorser head assembly 55. As illustrated in FIGS. 5, 6 and 7 the ink transfer member 57, forming the subject matter of U.S. Pat. No. 4,028,286 by J. Neri and J. Williams is rotatably housed within a cartridge 215 which in turn is rotatably supported on the friction setting plate 121. The cartridge 215 is provided with a central aperture 217 (FIG. 5) for receiving a mounting post 219 fixed to the friction setting plate 121. A cutaway aperture 221 formed in the wall of the cartridge 215, as best shown in FIGS. 2 and 5, serves to provide exposure of the ink transfer member 57 to the endorser head assembly 55, and a pair of spaced apart limit pins 223 fixed to the upper surface of the plate 121 serve to limitably cooperate with the bottom edge of the cartridge to prevent the cartridge from rotating into contact with the endorser head assembly 55. As also indicated supra, the friction setting plate 121 is pivotably mounted on the anchor plate 109 by means of a pivot pin 119 fixed to the friction plate 121 and rotatably mounted in an aperture 116 formed in an extension 117 of the anchor plate 109, as best illustrated in FIGS. 5 and 7. The friction setting plate 121 may be pivotally activated as between the clockwise-rocked friction relieving position illustrated in FIG. 10B, and the counterclockwise-rocked maximum friction position illustrated in FIG. 10A, such positions being defined by the ends of an adjustment slot 225 formed in the plate 121 and the previously referenced short shaft 103 fixed to an offset arm 227 of the third bearing mount 97. A second slot 229 formed in the friction plate 121 serves to accommodate the previously referenced biased detent 99 transversely supported by the collar housing 115 of the third bearing mount 97.

Figure 11:
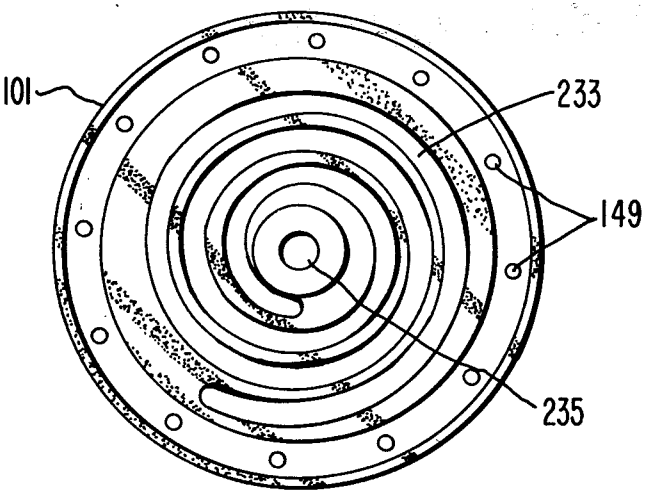
FIG. 11 is a bottom view of the adjusting knob of the friction setting means showing the spiral groove and the plurality of spaced apart detent receiving indentations formed therein.

As also best illustrated in FIGS. 5, 10A and 10B, the friction setting plate 121 is provided with a fixed stud or pin 231 disposed adjacent an extremity of the adjustment slot 225, such stud being engaged with a spiral groove 233 formed in the bottom surface of the adjusting knob 301, as shown in FIG. 11. The adjusting knob 101 is provided with a central aperture 235 by means of which the knob is mounted on the short shaft 103 and retained in position thereon by a C-shaped spring clip 237 disposed in a groove formed in the short shaft 103 contiguous to its uppermost extremity. The adjusting knob 101 is assembled on the short shaft 103 in such manner that the spiral groove 233 is engaged by the fixed stud 231, the arrangement being such that the full counterclockwise rotation of the knob 101 will cammably activate the stud 231 to the minimum radius of the spiral groove 233, to thereby dispose the friction setting plate 121 in its full clockwise-rocked friction-relieving position, and the clockwise rotation of the adjusting knob 101 will cammably activate the fixed stud 231 in the direction of the grooves maximum radius, to thereby adjustably dispose the friction setting plate 121 in a variable counterclockwise-rocked position wherein the ink transfer roller 57 is disposed in the desired frictional contact with the endorser head assembly 55. The adjustment of the knob 101 and the ink transfer member 57 is maintained by the engagement of the biased detent 99 with one of the indentions 149 formed in the bottom surface of the knob outwardly of the spiral groove 233.

It can be seen from FIGS. 6 and 7 that the elastomeric band 205 and projections 207 and 209 forming the velocity control member of the endorser head assembly 55 are disposed on a plane upwardly adjacent the ink transfer member 57, and that the establishment of the desired frictional contact between the ink transfer member 57 and endorser head assembly 55 will not dispose a supply of ink on the elements of the velocity control member. On the other hand, the above described adjustment of the knob 101 will serve to establish a desired minimal contact between the ink transfer member 57 and both the ink stamp 189 and the arcuate surfaces 163 and 165 of the platen element 161, rotation of the endorser head assembly 55 by the drive motor 63 accordingly bringing the ink stamp 189 and the arcuate surfaces 163 and 165 of the platen into rotating frictional relationship with the ink transfer member 57, to thereby apply a coating of ink on said surfaces. The ink transfer member 57 is accordingly rotated a distance corresponding to the arcuate surfaces 163 and 165 during each revolution of the endorser head assembly 55.

Figure 12:
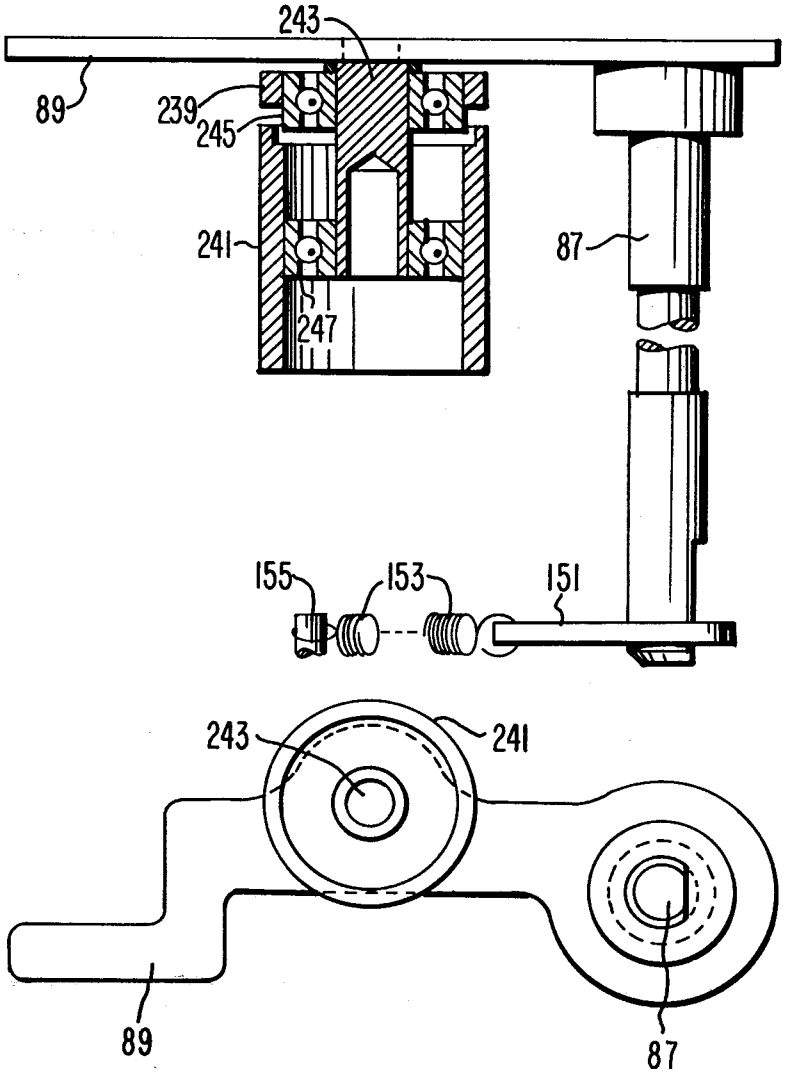
FIG. 12 is a view of the biased back-up support means that yieldably cooperates with the velocity control element and the ink stamp of the endorser head assembly shown in FIG. 9.

The previously mentioned biased back-up support means 61 with its rotatable shaft 87, roller carrying arm 89, and spring biased arm 151, is shown in FIG. 12 to be comprised of a first hard-surfaced roller 239 and a second hard-surfaced roller 241, said rollers being rotatably mounted on a common shaft 243 fixed to the arm 89. The first roller 239 is rotatably supported by a first ball bearing raceway 245 and the second roller 241 is supported by a second ball bearing raceway 247. As illustrated in FIGS. 6 and 7, the first roller 239 provides biased back-up support for the velocity control projections 207 and 209 of the endorser head assembly 55 to thereby control the speed of travel of a document impinged therebetween, and the second roller 241 provides biased back-up support for the inked ink stamp 189, to thereby print the legend carried to the ink stamp on a document impinged therebetween. The central support provided the second roller 241 by the relatively thin second ball bearing raceway 247 serves to accord the roller 241 with a self-centering characteristic, to further enhance the back-up capability of the roller with respect to the ink stamp 189.

Operation

Figure 4:
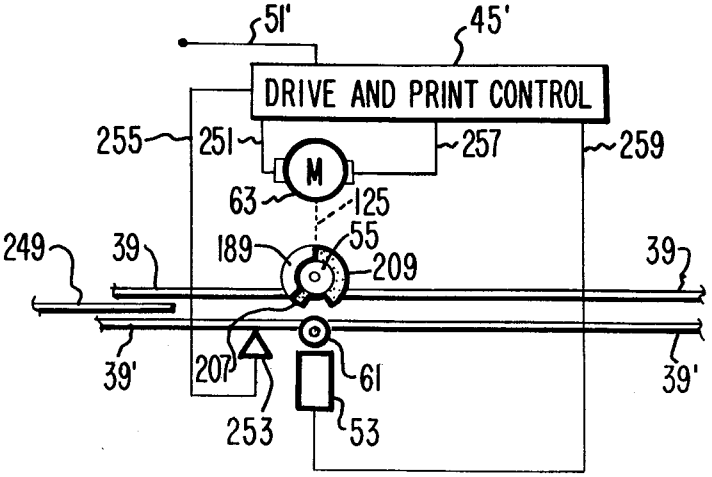
FIG. 4 is a block diagram illustrating the arrangement of various of the elements of the unitary endorser along the transport path in the area of the endorser station.

An understanding of the operation of the endorsing unit may be had with reference to FIGS. 3 and 4. If can be seen from FIG. 4 that with the endorsing head assembly 55 disposed in its home position (as also shown in FIG. 5) the various elements of the assembly are displaced from the document transport path to thereby permit documents that are not to receive endorsements to pass without interference through the endorser station defined by the path-defining walls 39, 39'. Such documents would accordingly remain under the control of the upstream and downstream drive 41 and the drive means 35, 35' shown in FIG. 3. It will be apparent from FIG. 3 that the upstream and downstream drive means 35, 35' would be spaced apart a distance less than the length of the documents being processed, such that the leading edge of a document would be received by the downstream feed rollers 35, 35' before the trailing edge of the document is released by the upstream feed rollers 35, 35'. Upon receipt of a signal along the line 51' in FIG. 4, to thereby initiate the endorsable printing of both fixed and variable information on a document entering the endorsing station, Drive and Print Control Means represented by the block 45' would serve to gateably transmit a drive signal along the line 251 to the drive motor 63, such drive signal being transmitted upon receipt of a signal from an LED and photodetector 253 along a line 255. Upon receipt of the drive signal along the line 251, the drive motor 63 and motor shaft thereof (represented by the line 125) would serve to rotate the endorser head assembly 55 in a counterclockwise direction and at a controlled speed corresponding to the decelerated speed of the documents through the endorsing station. Upon the initial counterclockwise rotation of the endorser head assembly 55, the first projection 207 of the elastomeric band 205 would either serve to block the incoming document 249 or to impinge the document against the first (topmost) roller 239 of the biased back-up support means 61, depending upon the length of the incoming document. Immediately upon the impingement of the document between the projection 207 and the topmost roller of the back-up support means 61, the document would be decelerated from the higher upstream transit speed to the endorsing speed, as determined by the controlled rotational speed of the drive motor 63. Following the initiation of the motor's rotation, feedback information would be supplied the print control section of the Drive and Print Control Means 45' along a line 257, and print pulses selectively transmitted along the line 259 to the wire matrix printer 53. It can be seen from FIG. 4 that as the endorser head assembly 55 is rotated one complete revolution in a counterclockwise direction by the motor 63, the fixed information contained on the inked ink stamp 189 would be printed on the document as it is impinged against the second (lowermost) roller 241 of the biased back-up support means 61, and the variable information printed by means of the wire matrix printer 53 as the document is supported by the inked arcuate surface 163 of the platen 61 (the platen 161 and arcuate surfaces thereof not being shown in FIG. 4). It is to be understood in viewing FIG. 4 that the selectively activatable pins of the wire printer 53 are disposed underneath the biased back-up support means 61 and cooperate directly with the platen 161 disposed at the lowermost level of the endorser head assembly 55. Following the printing of the fixed information by the ink stamp 189 and the variable information by the pins of the wire matrix printer 53, the second projection 209 of the endorser head assembly 55, in cooperation with the first roller 239 of the back-up support means 61 would serve to maintain the reduced transit speed of the document during the remainder of the endorsing cycle, and until the endorser head assembly 55 is re-established in its home position. Prior to the release of the endorsed document by the projection 209 of the endorser head assembly 55 and the first roller 239 of the back-up support means 61, the leading edge of the endorsed document would be engaged by the downstream drive means 35, 35' (FIG. 3) which are rotating the keeping with the faster upstream and downstream transit speed, such that upon release of the endorsed document by the projection 209 and the first roller 239, the endorsed document would be re-accelerated to the faster transit speed and transported to the selected pocket 15 shown in FIG. 1.

Although for inventive endorser device for printing both fixed and variable information has been described and illustrated in considerable detail, it is to be understood that various modifications and changes therein may be made by those skilled in the art without departing from the true spirit and scope of the invention, as specifically defined in the appended claims.

What is claimed is:

1. In a base-supported printing device for use in a document processor, wherein it is required that a coating of ink be applied to one or more rotatably operable print producing elements of the device for each printing cycle, improved ink applying means comprising:

(a) an inked roller rotatably mounted within a cutaway cartridge having a central aperture such that a predetermined arcuate portion thereof is exposed, (b) means for mounting said cartridge in contiguous relationship with said print producing elements and such that said exposed arcuate portion of said inked roller is limitably disposed in juxtaposed relationship therewith, said mounting means including a cartridge supporting plate pivotally connected along a predetermined side edge thereof to said base of said printing device, said cartridge supporting plate being provided with a cartridge mounting post adjacent the pivotal connection between said plate and said base, a pair of spaced apart cartridge limit pins disposed along the end of said cartridge supporting plate interfacing with said print producing elements, a first arcuate slot disposed adjacent the end of said cartridge supporting plate remote from said interfacing end, a cammable pin disposed adjacent a predetermined end of said first arcuate slot, a second arcuate slot disposed intermediate said first arcuate slot and said cartridge mounting post, and a mounting post fixed to said cartridge supporting plate said post extending coaxially through said central aperture of said cartridge, and (c) means for pivotally and retainably adjusting said mounting means relative to said base such that a predetermined minimal frictional contact is established between the exposed arcuate portion of said inked roller and said print producing elements, said frictional contact being effective to deposit a coating of ink on said print producing elements during the terminal phase of their operable rotation in each printing cycle.

2. The improved ink applying means defined in claim 1 wherein said adjusting means comprises an adjustment knob rotatably mounted on a pivot shaft fixed to the base of said printing device and extending through said first arcuate slot, said adjustment knob being provided with a central aperture for receiving said pivot shaft, and provided also, on the bottom surface thereof, with a continuous spiral groove extending from a terminal end adjacent said central aperture to a terminal end in substantial proximity to the outer periphery of said knob, said spiral groove being engaged by said cammable pin of said cartridge supporting plate such that upon the full rotation of said knob in a first direction the cammable pin is moved a maximum distance toward said pivot shaft to thereby rotate said plate and said cartridge away from said print producing elements, and such that upon the rotation of said knob a variable distance in a second direction the cammable pin is moved a variable distance away from said pivot shaft to thereby establish said predetermined minimal frictional contact between said exposed arcuate portion of said inked roller and said print producing elements of said printing device.

3. The improved ink applying means defined in claim 2 wherein the adjustment of said adjusting means to establish said predetermined minimal frictional contact between said exposed arcuate portion of said inked roller and said print producing elements is retained by means of a biased detent supported by said base of said printing device and extending through said second arcuate slot formed in said cartridge supporting plate, said biased detent being retainably engaged by a selected one of a plurality of equally spaced apart locating indentations formed in the bottom surface of said adjustment knob outwardly adjacent the outer periphery of said continuous spiral groove.

4. The improved ink applying means defined in claim 1 wherein said pair of spaced apart cartridge limit pins of said cartridge supporting plate cooperate with the outer extremities of the cutaway portion of said cartridge to thereby limit the rotation of said cartridge on said mounting post and to prevent said cartridge from coming into contact with said print producing elements of said printing device.

* * * * *

UNITED STATES PATENT OFFICE

CERTIFICATE OF CORRECTION

PATENT NO. : 4,133,262

DATED : January 9, 1979

INVENTOR(S) : Jack Beery

It is certified that error appears in the above-identified patent and that said Letters Patent are hereby corrected as shown below:

Abstract, Line 23, should be --the curvilinear--.
Col. 1, Line 18, should be --"A Straight Line Read System"--.
Line 20, should be --U.S. Patent No. 4,068,212--.
Line 24, should be --U.S. Patent No. 3,972,522--.
Line 27, should be --U.S. Patent No. 4,015,701--.
Col. 2, Line 19, should be --common elements--.
Col. 4, Line 9, should be --read station--.
Line 52, after transporting and before at insert --documents--.
Col. 6, Line 11, after bearing and before 93 insert --mount--.
Col. 9, Line 32, should be --translatably supported--.
Line 39, should be -- knob 101--.
Col. 11, Line 31, after platen and before (the insert --161--.
Line 51, should be --in keeping--.

Signed and Sealed this

Ninth Day of October 1979

[SEAL]

Attest:

RUTH C. MASON
Attesting Officer

LUTRELLE F. PARKER
Acting Commissioner of Patents and Trademarks